US008454376B1

(12) United States Patent
Siebens

(10) Patent No.: US 8,454,376 B1
(45) Date of Patent: Jun. 4, 2013

(54) ELECTRICAL CONNECTOR WITH SACRIFICIAL COMPONENT

(75) Inventor: Larry N. Siebens, Asbury, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 13/362,194

(22) Filed: Jan. 31, 2012

Related U.S. Application Data

(60) Provisional application No. 61/558,204, filed on Nov. 10, 2011.

(51) Int. Cl.
*H01R 13/53* (2006.01)

(52) U.S. Cl.
USPC ..... 439/181

(58) Field of Classification Search
USPC ..... 439/181, 184, 183, 185, 921, 205
See application file for complete search history.

(56) References Cited

U.S. PATENT DOCUMENTS

| | | | | |
|---|---|---|---|---|
| 3,363,171 | A | 1/1968 | Sietmann et al. | |
| 3,390,331 | A | 6/1968 | Brown et al. | |
| 3,711,818 | A | 1/1973 | Swehla | |
| 3,853,375 | A | 12/1974 | McClain | |
| 3,924,919 | A | 12/1975 | McClain | |
| 4,660,909 | A | 4/1987 | Wilson | |
| 5,421,750 | A | 6/1995 | Crotty | |
| 5,427,538 | A | 6/1995 | Knapp et al. | |
| 6,210,206 | B1 | 4/2001 | Durham | |
| 6,939,151 | B2 * | 9/2005 | Borgstrom et al. | 439/187 |
| 6,971,926 | B1 | 12/2005 | Walton | |
| 7,044,760 | B2 * | 5/2006 | Borgstrom et al. | 439/187 |
| 7,104,822 | B2 * | 9/2006 | Jazowski et al. | 439/181 |
| 7,104,823 | B2 * | 9/2006 | Jazowski et al. | 439/181 |
| 7,108,568 | B2 * | 9/2006 | Jazowski et al. | 439/801 |
| 7,134,889 | B2 * | 11/2006 | Hughes et al. | 439/184 |
| 7,878,849 | B2 | 2/2011 | Hughes et al. | |
| 7,958,631 | B2 | 6/2011 | Hughes et al. | |
| 2012/0264321 | A1 * | 10/2012 | Siebens et al. | 439/296 |

* cited by examiner

*Primary Examiner* — Tulsidas C Patel
*Assistant Examiner* — Phuongchi Nguyen
(74) *Attorney, Agent, or Firm* — Snyder, Clark, Lesch & Chung, LLP

(57) ABSTRACT

An electrical connector assembly includes a housing body that includes a cable receiving end having a first bore extending therethrough and at least one equipment end projecting perpendicular to the cable receiving end. The at least one equipment end includes a second bore extending therethrough that communicates with the first bore in the cable receiving end. A sacrificial bar is configured to be received within the cable receiving end and includes a first end for coupling to an end of a prepared electrical power cable and a second end configured to project into the second bore and conductively couple with an electrical device received within the at least one equipment end. The housing body and sacrificial bar are configured to be cut through to confirm that the electrical connector is de-energized.

21 Claims, 8 Drawing Sheets

ELECTRICAL CONNECTOR WITH SACRIFICIAL COMPONENT

CROSS-REFERENCE TO RELATED APPLICATION

This application is a non-provisional of U.S. Provisional Patent Application No. 61/558,204 filed on Nov. 10, 2011, the entirety of which is hereby incorporated by reference herein.

BACKGROUND OF THE INVENTION

The present invention relates to electrical cable connectors, such as splicing connectors for joining two or more electrical cables, loadbreak connectors, and deadbreak connectors. More particularly, aspects described herein relate to an electrical cable connector that includes a feature for enabling personnel to confirm that the connector is de-energized.

High and medium voltage electrical connectors and components typically operate in the 15 to 35 kilovolt (kV) range. Because such voltages are potentially very dangerous, it is typically necessary for personnel to confirm that the power is disconnected before commencing work or repair. Known methods of visual or physical de-energizing confirmation include "spiking the cable," in which a grounded spike is driven thru the cable and into the conductor or a grounded hydraulic cable cutter is used to physically cut or sever the cable in half.

Problematically, after a cable is "spiked," the utility is required to replace or re-terminate the cable or increase its length by adding a splice and additional cable in order to reconnect to the system. This is costly and time consuming.

DETAILED DESCRIPTION OF THE PREFERRED EMBODIMENTS

The following detailed description refers to the accompanying drawings. The same reference numbers in different drawings may identify the same or similar elements.

One or more embodiments disclosed herein relate to a power cable connector, such as an elbow or T-connector having a sacrificial component. More specifically, the connector may include a power cable receiving body and at least one T-end projecting substantially perpendicularly from the receiving body. The power cable receiving portion is configured to receive a power cable and the T-end is configured to receive an equipment bushing. The power cable operates by enabling current to flow between the bushing and the cable.

Power cables for use with the described embodiments include a terminating component, such as a spade connector affixed to a free end thereof. In normal operation, the end of the spade connector projects through the power cable receiving body into proximal relationship with the bushing positioned within the T-end. In some implementations, a bolt or other component may be inserted through an opening in the end of the spade connector and into a corresponding threaded aperture on the bushing. This facilitates conductive coupling of the power cable to the bushing by providing a securable conductive interface on an end of the power cable.

Consistent with embodiments described herein, a conductive, sacrificial bar (also referred to as a "link" or "bridge") may be interposed between the power cable terminating component (e.g., the spade connector) and the T-end. One end of the sacrificial bar may coupled to the terminating component and the other end of the sacrificial bar may project into the T-end for coupling with the bushing. An elbow housing having an extended length may accommodate insertion of both the terminated power cable elbow and the sacrificial bar and may include a marked portion corresponding to a position of the sacrificial bar. The marked portion may indicate that a cut of the connector at a marked location may be performed to verify that the power cable has been de-energized.

After being severed, the power cable may be removed from the cut elbow housing and the cut portion of the sacrificial bar may be removed or disassembled from the power cable terminating component. The T-end of the connector may be also disassembled from the bushing. A replacement sacrificial bar may be connected to the power cable terminating component and the power cable/sacrificial bar may be inserted into a replacement elbow housing. The connector may then be attached to the equipment bushing.

Figure 1A:
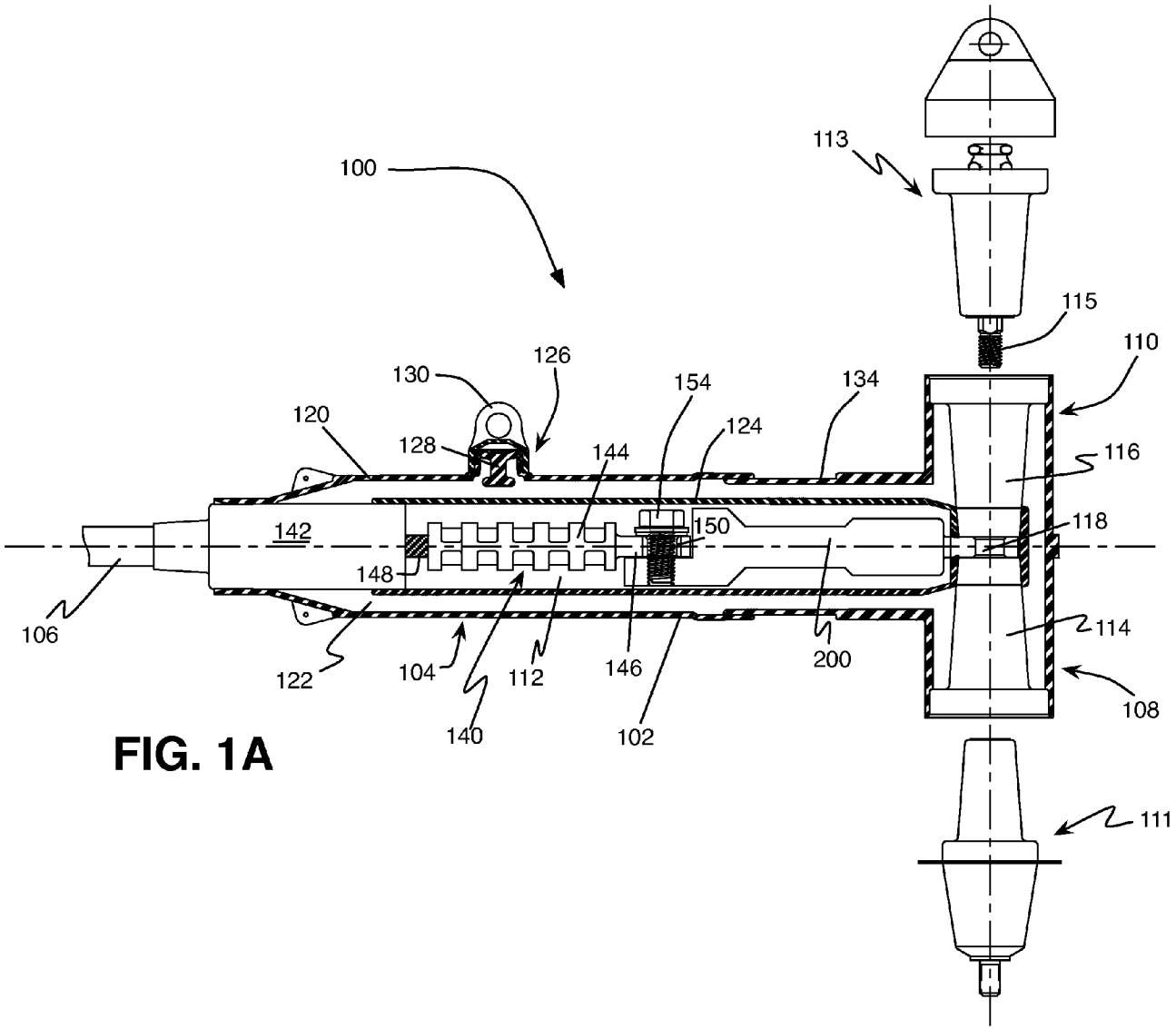
FIGS. 1A and 1B are schematic cross-sectional and side views, respectively, illustrating a sacrificial power cable elbow connector configured in a manner consistent with implementations described herein.
Figure 1B:
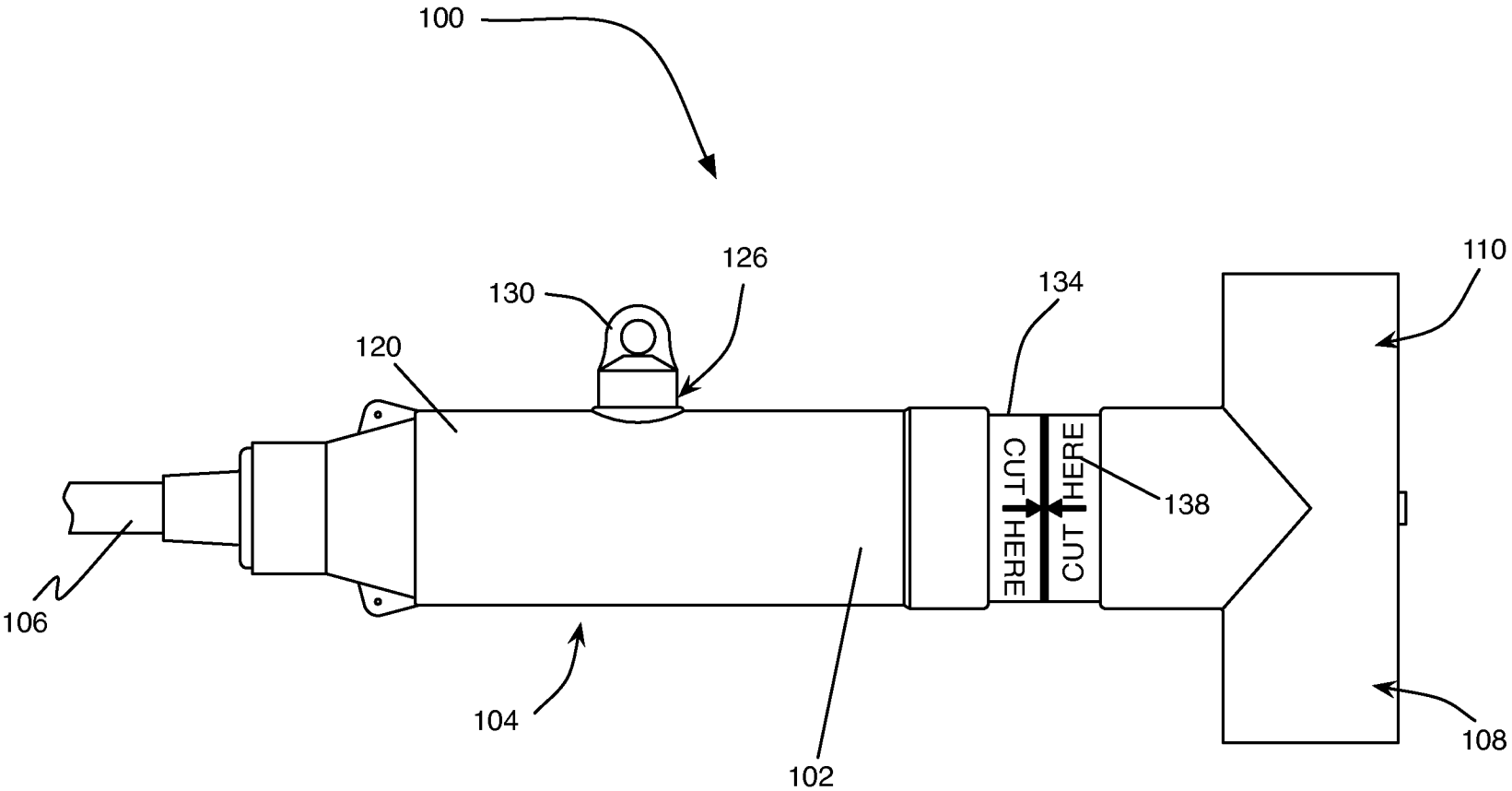

FIG. 1A is a schematic cross-sectional diagram illustrating a power cable elbow connector 100 configured in a manner consistent with implementations described herein. FIG. 1B is a side view of elbow connector 100. As shown in FIG. 1A, power cable elbow connector 100 may include a main housing body 102 that includes a conductor receiving end 104 for receiving a power cable 106 therein and first and second T-ends 108/110 that include openings for receiving an equipment bushing, such as a deadbreak transforming bushing 111 or other high or medium voltage terminal, such as an insulating plug 113, a grounding plug, or other power equipment.

As shown, conductor receiving end 104 may extend along a main axis of connector 100 and may include a bore 112 extending therethrough. First and second T-ends 108/110 may project substantially perpendicularly from conductor receiving end 104 in opposing directions from one another. First and second T-ends 108/110 may include bores 114/116, respectively, formed therethrough for receiving equipment, bushings, and/or plugs. A contact area 118 may be formed at the confluence of bores 112, 114, and 116.

Power cable elbow connector 100 may include an electrically conductive outer shield 120 formed from, for example, a conductive peroxide-cured synthetic rubber, commonly referred to as EPDM (ethylene-propylene-dienemonomer). Within shield 120, power cable elbow connector 100 may include an insulative inner housing 122, typically molded from an insulative rubber or epoxy material. Within insulative inner housing 122, power cable elbow connector 100 may include a conductive or semi-conductive insert 124 that surrounds the connection portion of power cable 106.

In one exemplary implementation, combined power cable elbow connector 100 may include a voltage detection test point assembly 126 for sensing a voltage in connector 100. Voltage detection test point assembly 126 may be configured to allow an external voltage detection device, to detect and/or measure a voltage associated with connector 100.

For example, as illustrated in FIG. 1A, voltage detection test point assembly 126 may include a test point terminal 128 embedded in a portion of insulative inner housing 122 and extending through an opening within outer shield 120. In one exemplary embodiment, test point terminal 128 may be formed of a conductive metal or other conductive material. In this manner, test point terminal 128 may be capacitively coupled to the electrical conductor elements (e.g., power cable 106) within connector 100.

A test point cap 130 may sealingly engage a portion of test point terminal 128 and outer shield 120. In one implementation, test point cap 130 may be formed of a semi-conductive material, such as EPDM. When test point terminal 128 is not being accessed, test point cap 130 may be mounted on test point assembly 126. Because test point cap 130 is formed of a conductive or semi-conductive material, test point cap 130 may ground test point terminal 128 when in position.

Consistent with embodiments described herein, main housing body 102 of power cable elbow connector 100 may include a sacrificial portion 134 formed therein. As shown in FIG. 1B, in one embodiment, sacrificial portion 134 may be positioned in a region of main housing body 102 between test point assembly 126 and T-ends 108/110 and corresponding to a location of a sacrificial bar 200, described below. As shown in FIG. 1B, an outer surface of main housing body 102 in sacrificial portion 134 may include surface markings 138 indicating that sacrificial portion 134 may be cut to verify that connector 100 has been de-energized.

Conductor receiving end 104 of power cable elbow connector 100 may be configured to receive a prepared end of power cable 106 therein. For example, a forward end of power cable 106 may be prepared by connecting power cable 106 to a conductor spade assembly 140. More specifically, conductor spade assembly 140 may include a rearward sealing portion 142, a crimp connector portion 144, and a spade portion 146.

Rearward sealing portion 142 may include an insulative material surrounding a portion of power cable 106 about an opening of conductor receiving end 104. When conductor spade assembly 140 is positioned within connector body 102, rearward sealing portion 142 may seal an opening of conductor receiving end 104 about power cable 106.

Crimp connector portion 144 may include a substantially cylindrical conductive assembly configured to receive a center conductor 148 of power cable 106 therein. Upon insertion of center conductor 148 therein, crimp connector portion 144 may be crimped onto power center conductor 148 prior to insertion of cable 106 into conductor receiving end 104.

Spade portion 146 may be conductively coupled to crimp connector portion 144 and may extend axially therefrom. For example, in some implementations, spade portion 146 may be formed integrally with crimp connector portion 144 and be made of a conductive metal, such as steel, brass, aluminum, etc. As shown in FIG. 1A, spade portion 146 may include a bore 150 extending perpendicularly therethrough.

Figure 2B:
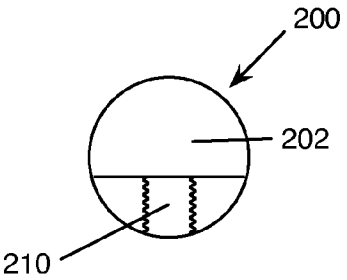
FIGS. 2A and 2B are schematic side and end views, respectively, of the sacrificial bar of FIG. 1A.
Figure 2A:
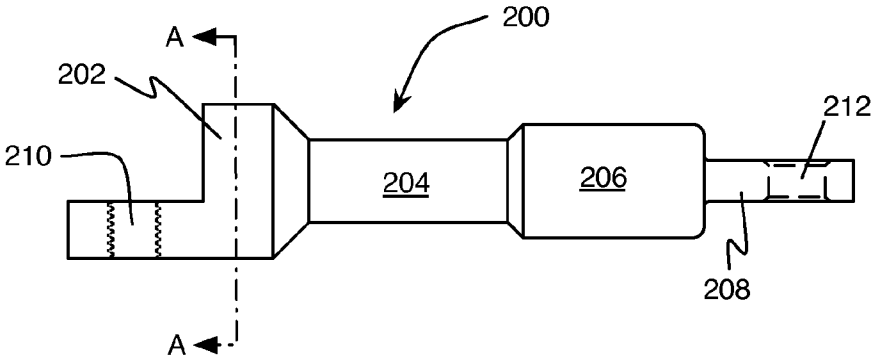

Consistent with embodiments, described herein, a sacrificial bar 200 may be provided in connector 100. As shown in FIG. 1A, sacrificial bar 200 may be removably coupled to conductor spade assembly 140 and may project axially into contact area 118 between T-ends 108 and 110. FIG. 2A is a side view of an exemplary embodiment of sacrificial bar 200. FIG. 2B is an end view of sacrificial bar 200 taken along the line A-A in FIG. 2A. As shown in FIG. 2A, sacrificial bar 200 may include a first spade end 202, a central bar portion 204, a forward conductor portion 206, and a second spade end 208.

As shown in FIG. 2A, sacrificial bar 200 may be formed or machined from a single conductive body, such as a brass or aluminum material. First spade end 202 may be configured to engage spade portion 146 of conductor spade assembly 140, as shown in FIG. 1A. For example, first spade end 202 may include a threaded bore 210 extending perpendicularly therethrough. Bore 210 is configured to align with bore 150 in spade portion 146. As shown in FIG. 1A, a connector bolt 154 may be inserted through bore 150 and into threaded bore 210 in first spade end 202. Tightening of bolt 154 secures sacrificial bar 200 to conductor spade assembly 140. Although FIG. 1A illustrates first spade end 202 of sacrificial bar 200 as being positioned below (or radially outside of) spade portion 146 of conductor spade assembly 140, in other embodiments, this relationship may be reversed.

As shown in FIGS. 1A and 2A, central bar portion 204 of sacrificial bar 200 may include a generally cylindrical configuration extending between first spade end 202 and forward conductor portion 206. As shown in FIG. 2A, in one embodiment, central bar portion 204 may include an outside diameter that is smaller than an outside diameter of either first spade end 202 or forward conductor portion 206. Further, as shown in FIG. 1A, central bar portion 204 may be configured to underlay surface markings 138 in sacrificial portion 134 of main housing body 102. The reduced diameter of central bar portion 204 may facilitate efficient severing of sacrificial bar 200 by field personnel.

As shown in FIG. 2A, forward conductor portion 206 may include a generally cylindrical configuration having an outside diameter that is larger than the outside diameter of central bar portion 204. Second spade end 208 may be conductively coupled to forward conductor portion 206 of sacrificial bar and may extend axially therefrom. As shown in FIG. 1A, upon insertion of sacrificial bar 200 into connector 100, second spade end 208 may project into contact area 118. As shown in FIG. 2A, second spade end 208 may include a perpendicular bore 212 extending therethrough. Once second spade end 208 is seated within contact area 118, bore 212 may allow a stud (e.g., stud 115 in FIG. 1A) or other coupling element (e.g., a pin, rod, bolt, etc.) to conductively couple second spade end 208 to an equipment bushing or other device received within bores 114 and/or 116 in T-ends 108 and 110, respectively.

Figure 3B:
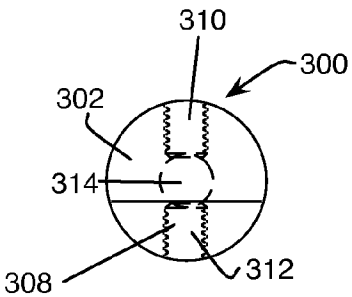
FIGS. 3A and 3B are schematic side and end views, respectively, of an other exemplary sacrificial bar assembly.
Figure 3A:
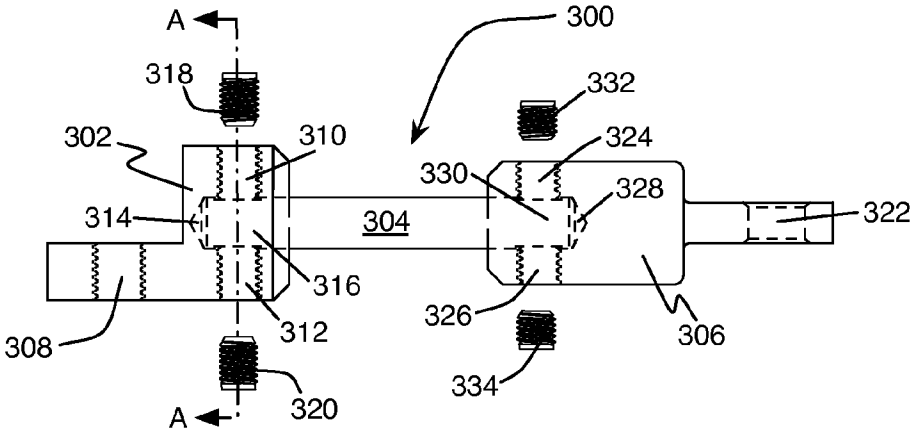

FIG. 3A is a side view of an alternative implementation of sacrificial bar 200 that includes a sacrificial bar assembly 300 of. FIG. 3B is an end view of sacrificial bar assembly 300 taken along the line A-A in FIG. 3A. As shown in FIG. 3A, sacrificial bar assembly 300 may be formed or machined from three modular conductive components, that include a first spade end component 302, a central bar component 304, and a second spade end component 306. As shown in FIG. 3A, consistent with this embodiment, central bar component 304 may be replaceable with respect to a remainder of sacrificial bar assembly, thereby reducing an amount of material necessary to replace sacrificial bar 200 upon re-assembly of connector 100 following cut-through.

Similar to first spade end 202 described above, first spade end component 302 may be configured to engage spade portion 146 of conductor spade assembly 140. For example, first spade end component 302 may include a threaded bore 308 extending perpendicularly therethrough. Bore 308 is configured to align with bore 150 in spade portion 146 to enable secure coupling of first spade end component 302 with spade portion 146 via connector bolt 154.

In addition, first spade end component 302 may include a first threaded aperture 310, a second threaded aperture 312, and a bar receiving cavity 314. As shown in FIG. 3B, first threaded aperture 310 may be diametrically opposed to second threaded aperture 312. Further each of first threaded aperture 310 and second threaded aperture 312 may communicate with bar receiving cavity 314. As shown, during assembly of electrical connector 100, a forward end 316 of central bar component 304 may be received within bar receiving cavity 314. Set screws 318 and 320 may be received within first threaded aperture 310 and second threaded aperture 312, respectively, and may engage rearward end 316 of central bar component 304, thereby fixing central bar component 304 relative to first spade end component 302.

In one implementation, opposing sides of rearward end 316 of central bar component 304 may include flattened portions. Set screws 318 and 320 may engage the flattened portions, thereby providing a more secure attachment of central bar component 304 to first spade end component 302.

Central bar component 304 of sacrificial bar assembly 300 may include a generally cylindrical configuration extending between first spade end component 302 and second spade end component 306. As shown in FIG. 3A, in one embodiment, central bar component 302 may include an outside diameter that is smaller than an outside diameter of either first spade end component 302 or second spade end component 306. Further, central bar component 304 may be configured to underlay surface markings 138 in sacrificial portion 134 of main housing body 102.

As shown in FIG. 3A, second spade end component 306 may include a generally cylindrical configuration having an outside diameter that is larger than the outside diameter of central bar component 304. Similar to second spade end 208 described above, second spade end component 306 may project axially from sacrificial bar assembly 300. As shown in FIG. 3A, second spade end component 306 may include a perpendicular bore 322 extending therethrough. Upon insertion of sacrificial bar assembly 300 into connector 100, second spade end component 306 may project into contact area 118. Once second spade end component 306 is seated within contact area 118, bore 322 may allow a stud or other coupling element (e.g., a pin, rod, bolt, etc.) to conductively couple second spade end component 306 to an equipment bushing or other device received within bores 114 and/or 116 in T-ends 108 and 110, respectively.

As shown in FIG. 3A, second spade end component 306 may further include a first threaded aperture 324, a second threaded aperture 326, and a bar receiving cavity 328. As shown in FIG. 3B, first threaded aperture 324 may be diametrically opposed to second threaded aperture 326. Further, each of first threaded aperture 324 and second threaded aperture 326 may communicate with bar receiving cavity 328. As shown, during assembly of elbow connector 100, a forward end 330 of central bar component 304 may be received within bar receiving cavity 328. Set screws 332 and 334 may be received within first threaded aperture 324 and second threaded aperture 326, respectively, and may engage forward end 330 of central bar component 304, thereby fixing central bar component 304 relative to second spade end component 306.

As described above with respect to rearward end 316 of central bar component 304, in one implementation, opposing sides of forward end 330 of central bar component 304 may also include flattened portions for engaging set screws 332 and 334.

Figure 4:
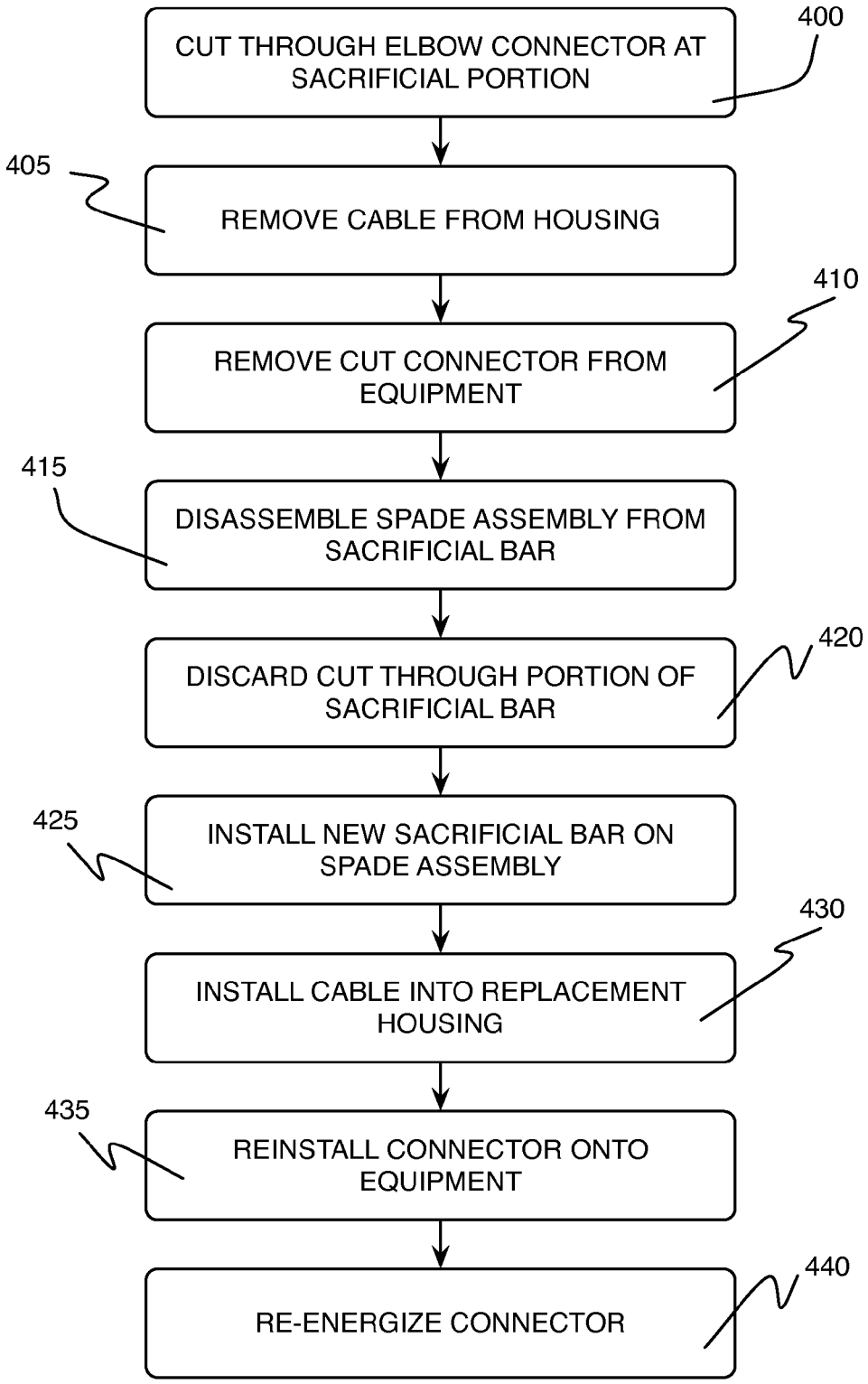
FIG. 4 is a flow diagram of an exemplary method for using the sacrificial power cable elbow connector of FIG. 1.

FIG. 4 is a flow diagram of an exemplary method for using the sacrificial power cable elbow connector 100 consistent with embodiments described herein. FIGS. 5A-8 are schematic illustrations of the process of FIG. 4 and are described in conjunction with the description of FIG. 4.

Figure 5A:
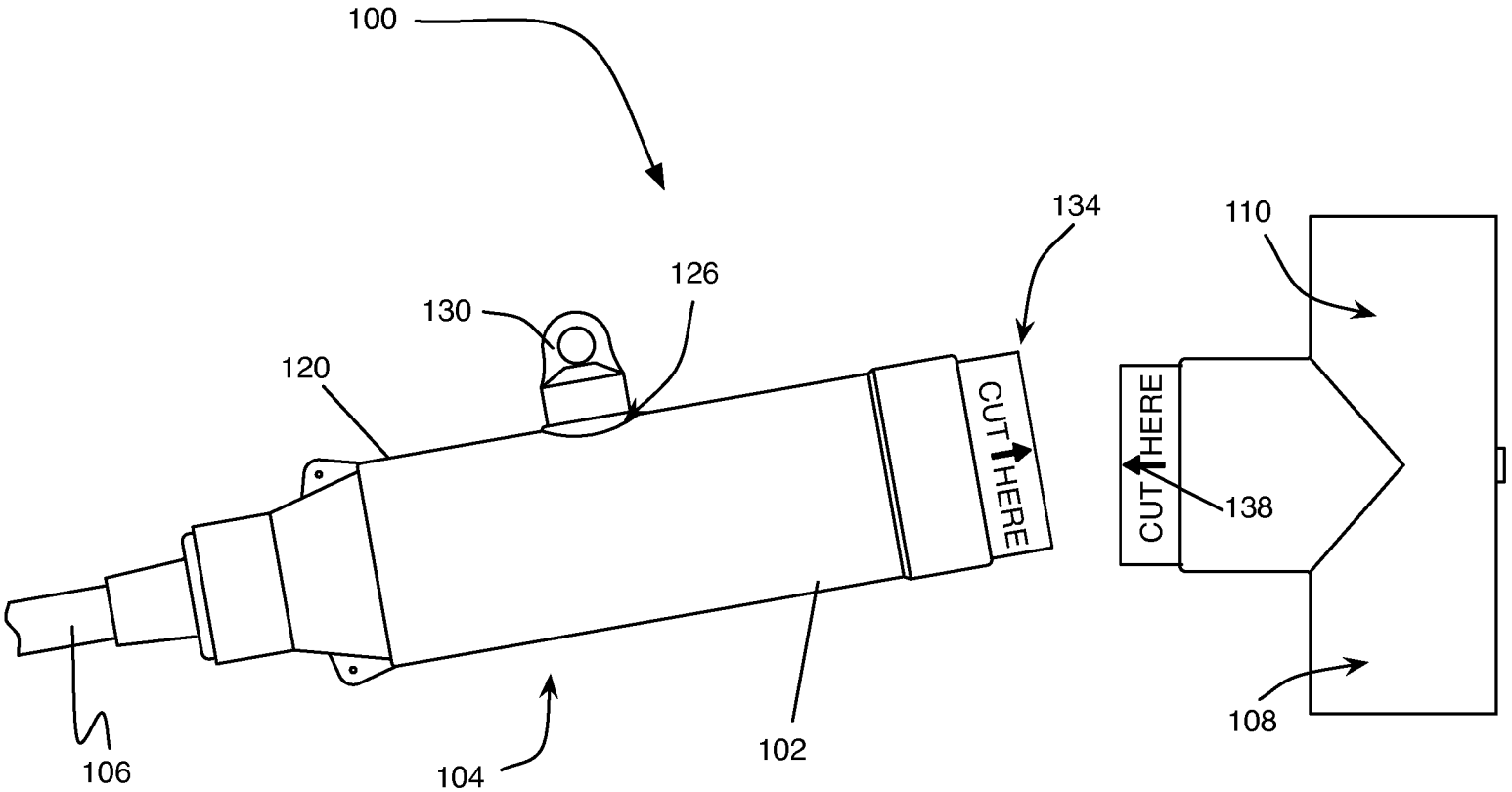
FIGS. 5A-8 are schematic illustrations of the process of FIG. 4.
Figure 5B:
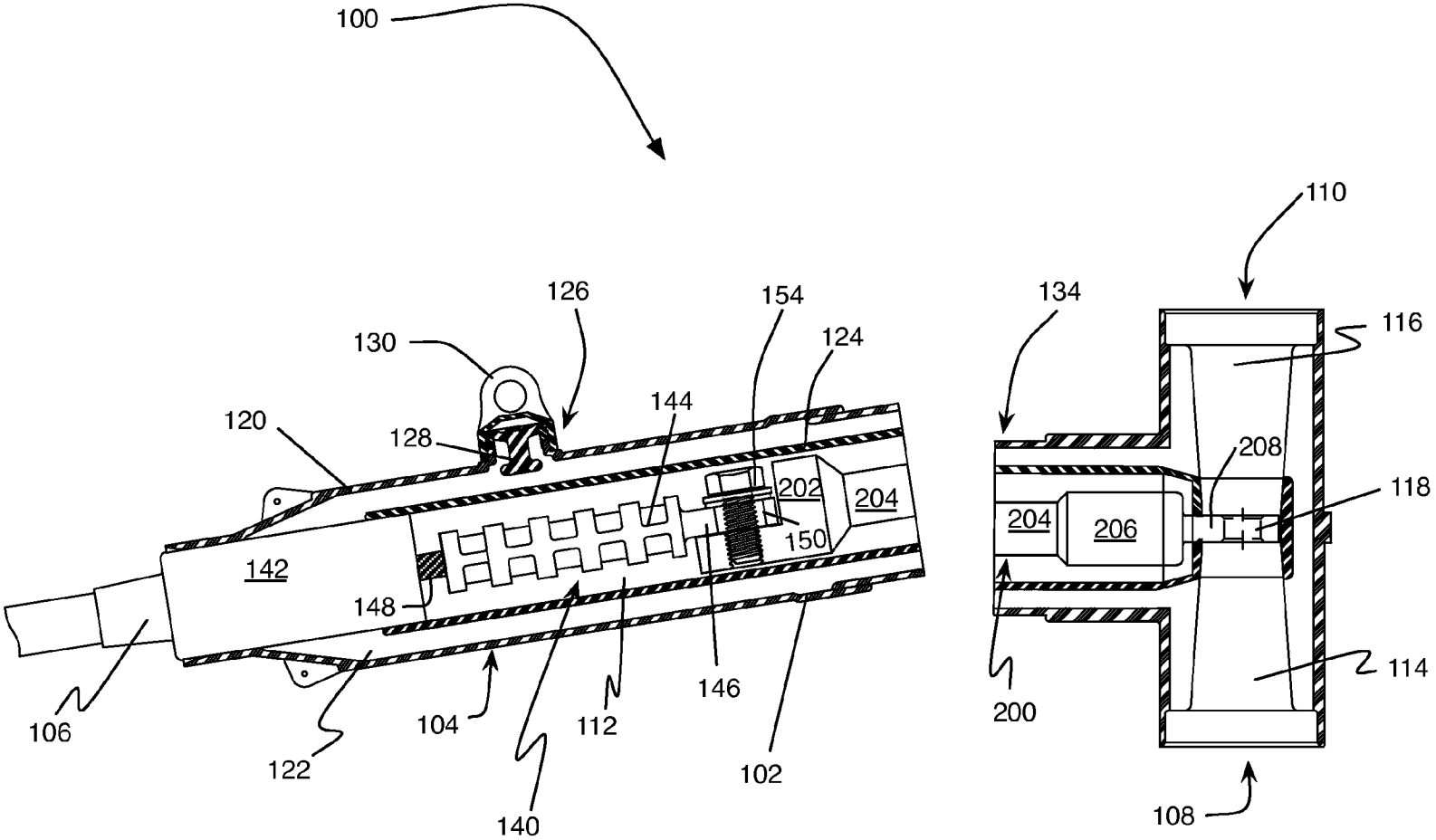

When it is necessary for work to be performed on power cable 106 (or any device connected to power cables 106), a worker may cut through connector 100 in a location proximate to sacrificial portion 134 of main housing body 102 (e.g., with a hydraulic cable cutter, or similar tool) to ensure that the electrical system that splicing connector 100 is connected to has been properly de-energized and is, therefore, safe to work on (block 400). As described above, sacrificial portion 134 of main housing body 102 is configured to overlay central bar 204/304 in sacrificial bar 200/300. Consequently, severing connector 100 at sacrificial portion 134 also severs central bar 204/304. This operation is schematically illustrated in FIGS. 5A (side view) and 5B (cross-sectional view).

Figure 6:
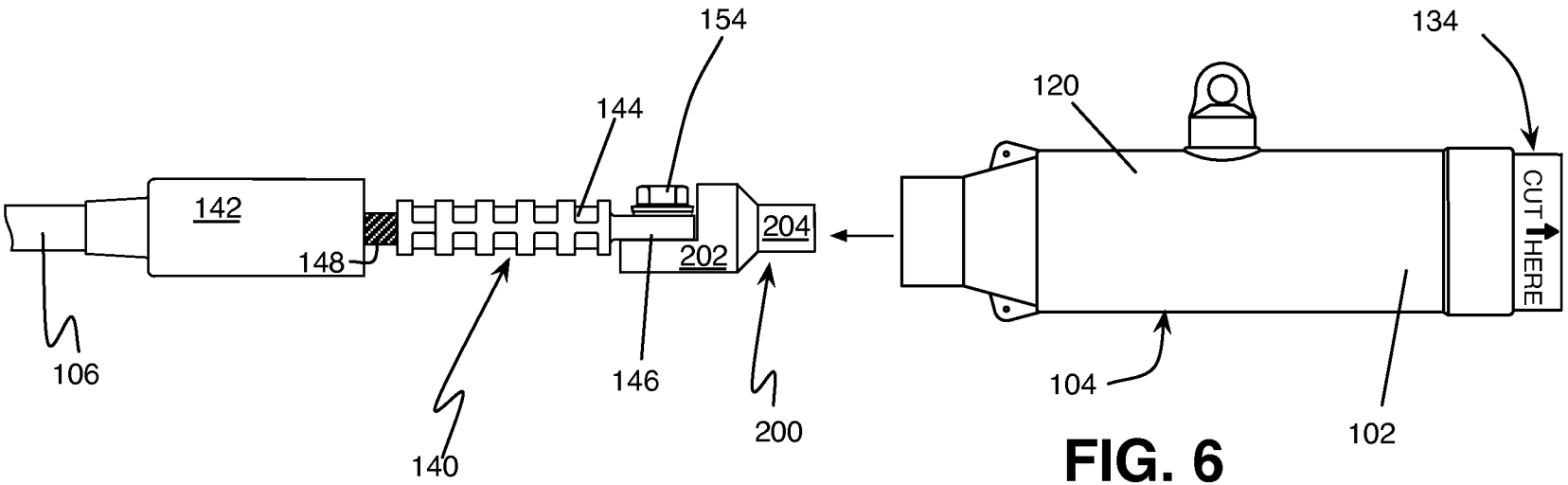

After the work has been completed and it is time to re-energize, power cable 106 may be removed from housing body 102 (block 405—FIG. 6). For example, power cable 106, spade connector assembly 140, and a cable-end 600 of cut-through sacrificial bar 200 may be removed from main housing body 102 of connector 100.

Although not shown in FIG. 6, a forward end (e.g., a bushing-side end) of the cut-through main housing 102 and sacrificial bar 200 may also be removed from the equipment bushing and any other connected device, such as an insulated plug may be removed (block 410). For example, a plug or stud securing the bushing to second spade end 208 may be removed. In an embodiment using one-piece sacrificial bar 200, the cut-through ends of main housing 102 and sacrificial bar 200 may be discarded. However, in an embodiment using modular sacrificial bar assembly 300, a cut-through end of sacrificial bar assembly 300 may be removed from cut-through main housing 102, and forward spade end component 306 may be removed from central bar component 304, e.g., by removing set screws 332 and 334.

Figure 7:
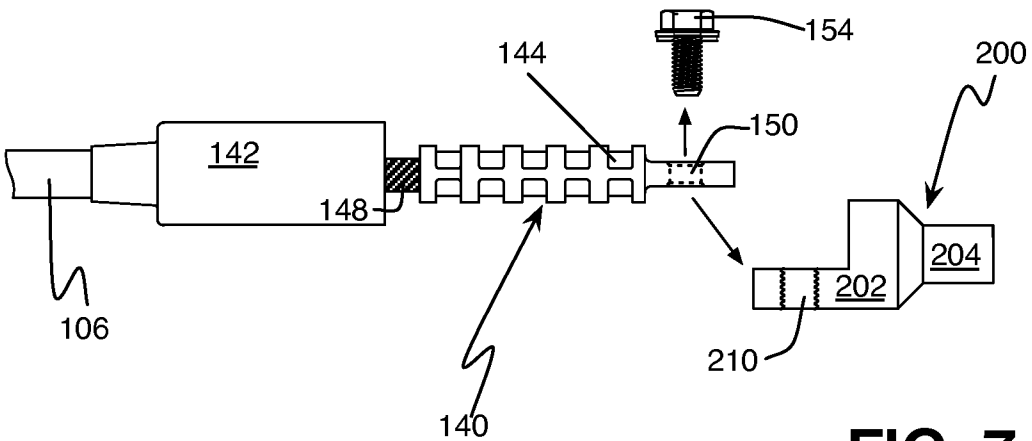

In any event, once removed from main housing 102, spade assembly 140 may be disassembled from the cut-through end of sacrificial bar 200 (block 415—FIG. 7). For example, connector bolt 154 may be removed from threaded bore 210 in first spade end 202.

The cut-through portion of sacrificial bar 200 may be discarded, as shown schematically in FIG. 7 (block 420). In the embodiment of FIGS. 3A and 3B, rather than discarding the entirety of sacrificial bar 300, the cut-through portion of central bar component 304 may be removed from first spade end component 302 (e.g., by removing set screws 318 and 320).

Figure 8:
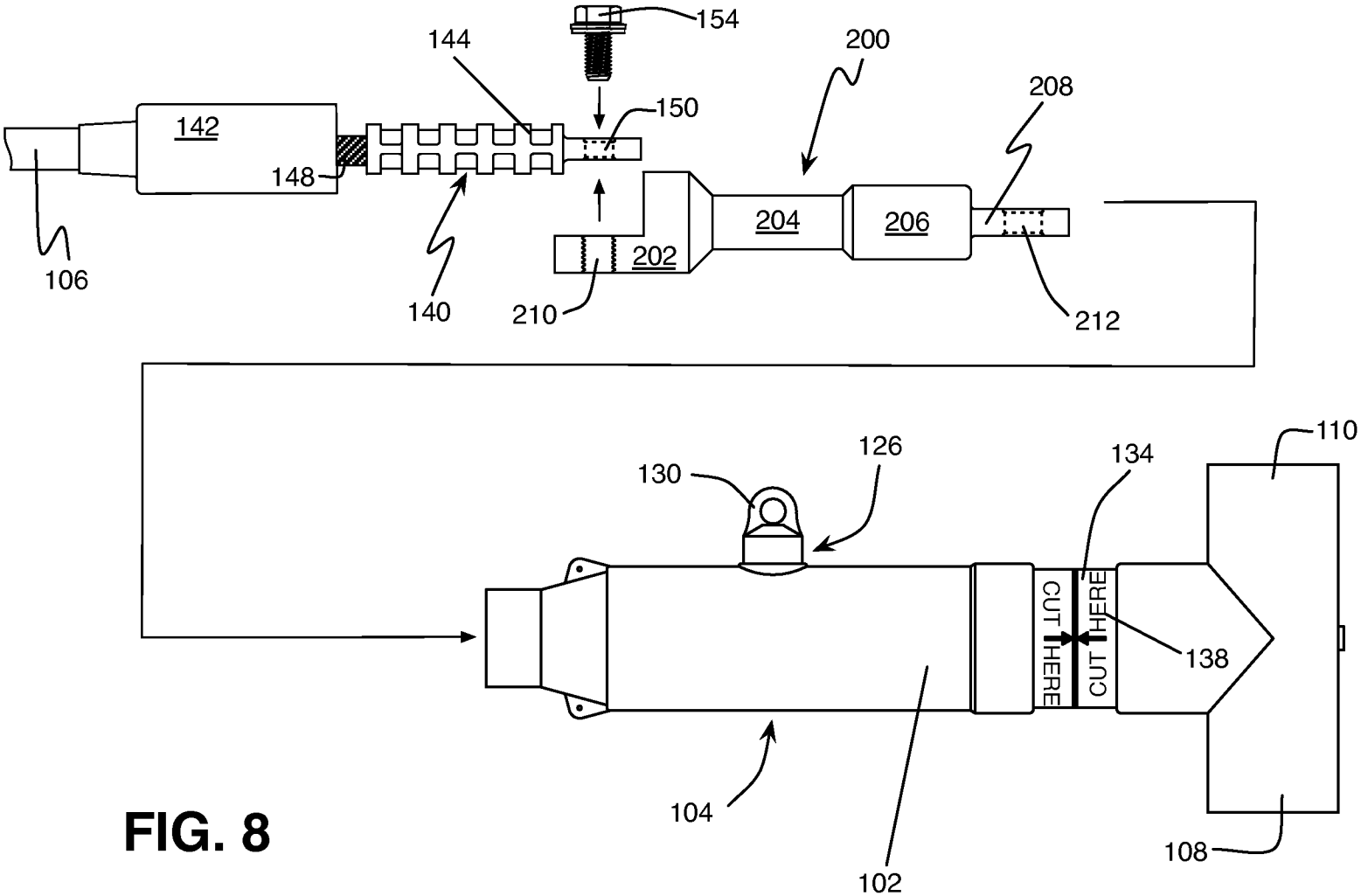

A new sacrificial bar 200 may be installed on spade assembly 140, as shown in FIG. 8 (block 425). For example, a replacement sacrificial bar 200 may be installed to spade assembly 140 via connector bolt 154. Alternatively, in the embodiment of FIGS. 3A and 3B, a replacement central bar component 304 may be mounted within first spade end component 302 and second spade end component 306, e.g., by tightening set screws 318, 320, 332, and 334. Sacrificial bar assembly 300 (with the replacement central bar component 304) may then be reassembled to spade assembly 140 via connector bolt 154.

Power cable 106, spade assembly 140, and sacrificial bar 200 may be installed into a replacement main housing body 102 (block 430). For example, power cable 106, spade assembly 140, and sacrificial bar 200 may be inserted into bore 112 in main housing cable receiving end 104 of main housing body 102, with second spade end 208 extending into contact area 118 proximate bores 114/116 in first and second T-ends 108/110 respectively.

Connector 100 may be reinstalled on the equipment bushing (block 435) and re-energized (block 440).

By providing a replaceable sacrificial bar for coupling to a prepared power cable, significant time and expense savings are realized. For example, following a cut-through operation, power cable 106 and spade assembly 140 need not be re-terminated or re-prepared, an operation requiring both significant time expenditure and further requiring that sufficient cable slack be available to accommodate the new termination (e.g., new spade connector). In the event that a required length of slack is not available, a costly and time-consuming cable splice must be performed. In contrast, connector 100 provides for an easily replaceable elbow housing 102 and sacrificial bar 200 and does not require re-termination of power cable 106.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations described herein may also be used in conjunction with other devices, such as high voltage switchgear equipment, including 15 kV, 25 kV, or 35 kV equipment.

For example, various features have been mainly described above with respect to electrical splicing connectors. In other implementations, other medium/high voltage power components may be configured to include the replaceable sacrificial bar configurations described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. An electrical connector assembly, comprising:

a housing body that includes:

a cable receiving end having a first bore extending therethrough; and at least one equipment end projecting perpendicular to the cable receiving end, wherein the at least one equipment end includes a second bore extending therethrough that communicates with the first bore in the cable receiving end, wherein the cable receiving end includes a sacrificial portion; and a sacrificial bar configured to be received within the cable receiving end in a position proximate to the sacrificial portion, wherein the sacrificial bar includes a first end for coupling to an end of a prepared electrical power cable and a second end configured to project into the second bore and conductively couple with an electrical device received within the at least one equipment end, wherein the sacrificial portion of the housing body and the sacrificial bar are configured to be cut through to confirm that the electrical connector is de-energized.

2. The electrical connector assembly of claim 1, wherein the at least one equipment end comprises a first T-end and a second T-end formed opposite of the first T-end.

3. The electrical connector assembly of claim 1, wherein the sacrificial portion of the cable receiving end includes a marking for indicating that the housing body can be cut through in the sacrificial portion.

4. The electrical connector assembly of claim 1, wherein the first end of the sacrificial bar includes a first spade portion for connecting to a mating spade portion on the prepared end of electrical power cable.

5. The electrical connector assembly of claim 4, wherein the first spade end includes an aperture for receiving a connector bolt therein to secure the spade portion on the prepared end of electrical power cable to the sacrificial bar.

6. The electrical connector assembly of claim 4, wherein the second end of the sacrificial bar includes a second spade portion to project into the second bore and conductively couple with an electrical device received within the at least one equipment end.

7. The electrical connector assembly of claim 6, wherein the sacrificial bar includes a central bar portion between the first end and the second end, wherein central bar portion is positioned in the position proximate to the sacrificial portion.

8. The electrical connector assembly of claim 7, wherein the sacrificial bar is formed as a single integral component.

9. The electrical connector assembly of claim 6, wherein the sacrificial bar further includes:

a first spade end component that includes the first spade portion;

a central bar component that includes the central bar portion; and a second spade end component that includes the second spade portion, wherein the first spade end includes a first cavity for receiving a first end of the central bar component, and wherein the second spade end includes a second cavity for receiving a second end of the central bar component.

10. The electrical connector assembly of claim 9, wherein the first end of the central bar component is secured in the first cavity by a first set screw, and wherein the second end of the central bar component is secured in the second cavity by a second set screw.

11. A medium or high voltage electrical connector assembly, comprising:

a housing body having a longitudinal bore extending therethrough for receiving a prepared power cable therein;

a first T-end projecting perpendicularly from the housing body and including a second bore that communicates with a forward end of the longitudinal bore;

a second T-end projecting perpendicularly from the housing body in a direction opposite to the first T-end, wherein the second T-end includes a third bore that communicates with the second bore and the forward end of the longitudinal bore;

a sacrificial bar assembly configured to be received within the longitudinal bore, wherein the sacrificial bar assembly includes a first end for coupling to an end of the prepared power cable and a second end configured to project into the second bore of the first T-end and the third bore of the second T-end, wherein the sacrificial bar assembly is configured to be cut through to confirm that the electrical connector assembly is de-energized.

12. The electrical connector assembly of claim 11, wherein the housing body includes a sacrificial portion corresponding to a location of the sacrificial bar assembly, wherein the sacrificial portion includes a marking for indicating that the housing body can be cut through in the sacrificial portion.

13. The electrical connector assembly of claim 11, wherein the first end of the sacrificial bar assembly includes a first spade portion for connecting to a mating spade portion on the prepared end of electrical power cable.

14. The electrical connector assembly of claim 13, wherein the second end of the sacrificial bar assembly includes a second spade portion to project into the second bore and the third bore.

15. The electrical connector assembly of claim 13, wherein the sacrificial bar assembly includes a central bar portion between the first end and the second end, wherein the central bar portion is configured to be cut through to confirm that the electrical connector assembly is de-energized.

16. A method, comprising:

coupling a first end of a sacrificial bar assembly to a prepared end of an electrical power cable, wherein the sacrificial bar assembly includes a second end configured to be coupled to an electrical equipment bushing;

inserting the sacrificial bar assembly and the prepared end of the electrical power cable into a longitudinal bore of a power cable electrical connector housing body, wherein the power cable electrical connector housing body includes at least one equipment end projecting perpendicular to the longitudinal bore, wherein the at least one equipment end includes a second bore extending therethrough that communicates with the longitudinal bore in the power cable electrical connector housing body, wherein the second end of the sacrificial bar assembly projects into the second bore;

coupling the second end of the sacrificial bar assembly to an electric device received in the second bore of the at least one equipment end;

cutting through the power cable electrical connector housing body and the sacrificial bar assembly to confirm that the power cable electrical connector is de-energized;

removing the prepared end of the electrical power cable and a cut portion of the sacrificial bar assembly from the longitudinal bore of the power cable electrical connector;

decoupling the cut portion of the sacrificial bar assembly from the prepared end of the electrical power cable;

removing the cut portion of the sacrificial bar assembly and the power cable electrical connector housing body;

coupling a replacement sacrificial bar assembly to the prepared end of the electrical power cable;

inserting the prepared end of the electrical power cable and the replacement sacrificial bar assembly into the longitudinal bore of a replacement power cable electrical connector housing body; and coupling the second end of the replacement sacrificial bar assembly to the electrical device received in the second bore of the at least one equipment end of the replacement power cable electrical connector housing body.

17. The method of claim 16, wherein coupling the first end of the sacrificial bar to the prepared end of the electrical power cable, further comprises:

coupling a first spade end of the sacrificial bar assembly to a mating spade end of the prepared end of the electrical power cable.

18. The method of claim 16, wherein the sacrificial bar assembly includes:

a first spade end component configured to couple to the prepared end of the electrical power cable;

a second spade end component configured to couple to the electrical equipment; and a central bar component positioned between the first spade end component and the second spade end component, wherein the first spade end component includes a first cavity for receiving a first end of the central bar component, and wherein the second spade end component includes a second cavity for receiving a second end of the central bar component.

19. The method of claim 18, wherein cutting through the power cable electrical connector housing body and the sacrificial bar assembly comprises:

cutting through the central bar component.

20. The method of claim 19, wherein decoupling the cut portion of the sacrificial bar assembly from the prepared end of the electrical power cable further comprises:

decoupling cut portions of the central bar component of the sacrificial bar assembly from the first spade end component and the second spade end component.

21. The method of claim 19, wherein coupling the replacement sacrificial bar assembly to the prepared end of the electrical power cable further comprises:

coupling a replacement central bar component to the first spade end component and the second spade end component.

* * * * *